United States Patent [19]

Honaga et al.

[11] Patent Number: 4,505,655

[45] Date of Patent: Mar. 19, 1985

[54] VANE PUMP WITH POSITIONING PINS FOR CAM RING AND SIDE PLATES

[75] Inventors: Susumu Honaga, Aichi; Satoshi Sutoh, Chiryu, both of Japan

[73] Assignee: Toyoda Koki Kabushiki Kaisha, Kariya, Japan

[21] Appl. No.: 584,306

[22] Filed: Mar. 5, 1984

Related U.S. Application Data

[63] Continuation of Ser. No. 331,757, Dec. 17, 1981, abandoned.

[30] Foreign Application Priority Data

Dec. 27, 1980 [JP] Japan ..... 55-187552[U]

[51] Int. Cl.[3] ..... F04C 2/00; F04C 15/00

[52] U.S. Cl. ..... 418/133; 418/135

[58] Field of Search ..... 418/131, 132, 133, 135; 417/300

[56] References Cited

U.S. PATENT DOCUMENTS

| | | | |
|---|---|---|---|
| T927,009 | 10/1974 | Ulrich | 418/133 |
| 2,962,973 | 12/1960 | Pettibone | 418/133 |
| 3,057,304 | 10/1962 | Rohde | 418/133 |
| 3,200,752 | 8/1965 | Clark et al. | 418/135 |
| 3,311,064 | 3/1967 | Eichele et al. | 418/133 |
| 3,334,591 | 8/1967 | Dymond | 418/133 |
| 3,439,623 | 4/1969 | Dietrich et al. | 418/135 |
| 3,728,046 | 4/1973 | Clark et al. | 418/133 |
| 4,207,038 | 6/1980 | Strikis | 418/75 |
| 4,289,454 | 9/1981 | Iwata | 417/300 |

FOREIGN PATENT DOCUMENTS

| | | | |
|---|---|---|---|
| 962131 | 2/1975 | Canada | 418/133 |

*Primary Examiner*—John J. Vrablik

*Attorney, Agent, or Firm*—Oblon, Fisher, Spivak, McClelland & Maier

[57] ABSTRACT

A vane pump for use in a power steering device comprising a pump housing receiving a cam ring therein. A pair of side plates are disposed at opposite side of the cam ring in contact relationship therewith. A pump rotor rotatable integrally with a drive shaft is received in an internal cam bore of the cam ring. An end cover is secured to the pump housing in contact relationship with one of the side plates to cover an open end of the pump housing. A first positioning pin is fitted at one end thereof into an inner end wall of the pump housing for positioning the first and second side plates in a circumferential direction. A second positioning pin is fitted at one end thereof into one of the first and second side plates for positioning the cam ring in the circumferential direction.

2 Claims, 3 Drawing Figures

VANE PUMP WITH POSITIONING PINS FOR CAM RING AND SIDE PLATES

This application is a continuation of application Ser. No. 331,737, filed Dec. 17, 1981 and now abandoned.

BACKGROUND OF THE INVENTION

1. Field of the Invention

The present invention relates to a vane pump for use in a power steering device.

2. Description of the Prior Art

As shown in FIG. 1, in a conventional vane pump, for use in a power steering of the type wherein a pair of side plates 6 and 7 are disposed within a pump housing 1 at opposite sides of a cam ring 5 receiving therein a pump rotor 3, in order to position the side plates 6 and 7 and the cam ring 5, a single positioning pin 13 is fitted at one end thereof into a boss portion 1*c* of the pump housing 1. The positioning pin 13 passes through an elongated hole 6*b* formed in the side plate 6 and a hole 5*a* formed in the cam ring 5 in fitted relation therewith. The other end of the positioning pin 13 is fitted into the side plate 7.

With this arrangement of the single positioning pin 13, the cam ring 5 has to be received in the pump housing 1 in fitted relationship therewith. This requires a grinding operation on the outer periphery of the cam ring 5 and causes the assembly of the cam ring 5 to be difficult. Furthermore, the axial width of an annular groove 10 leading to a pump reservoir is restricted, resulting in a lower suction efficiency.

SUMMARY OF THE INVENTION

It is therefore an object of the present invention to provide an improved vane pump for use in a power steering device which simplifies machining and assembling a cam ring.

Another object of the present invention is to provide an improved vane pump of the character set forth above, wherein a first positioning pin is provided to position side plates sandwiching the cam ring and a second positioning pin is provided to position the cam ring.

Briefly, according to the present invention, these and other objects are achieved by providing a vane pump for use in a power steering device, as mentioned below. A pump housing has an inner bore in which a cam ring having an internal cam bore is received. A first side plate is disposed in contact relationship with one side surface of the cam ring. A second side plate is disposed in contact relationship with the other side surface of the cam ring. A drive shaft is rotatably carried by the pump housing and extends into the internal cam bore. A pump rotor is carried on the drive shaft for integral rotation therewith and received in the internal cam bore. A plurality of vanes are radially slidably carried on the periphery of the pump rotor for contacting the internal cam bore to define a plurality of pump chambers therewith. An end cover is secured to the pump housing in contact relationship with the second side plate to cover an open end of the inner bore of the pump housing. A first positioning pin is fitted at one end thereof into an inner wall of the pump housing for positioning the first and second side plates in a circumferential direction. A second positioning pin is fitted at one end thereof into one of the first and second side plates for positioning the cam ring in the circumferential direction.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
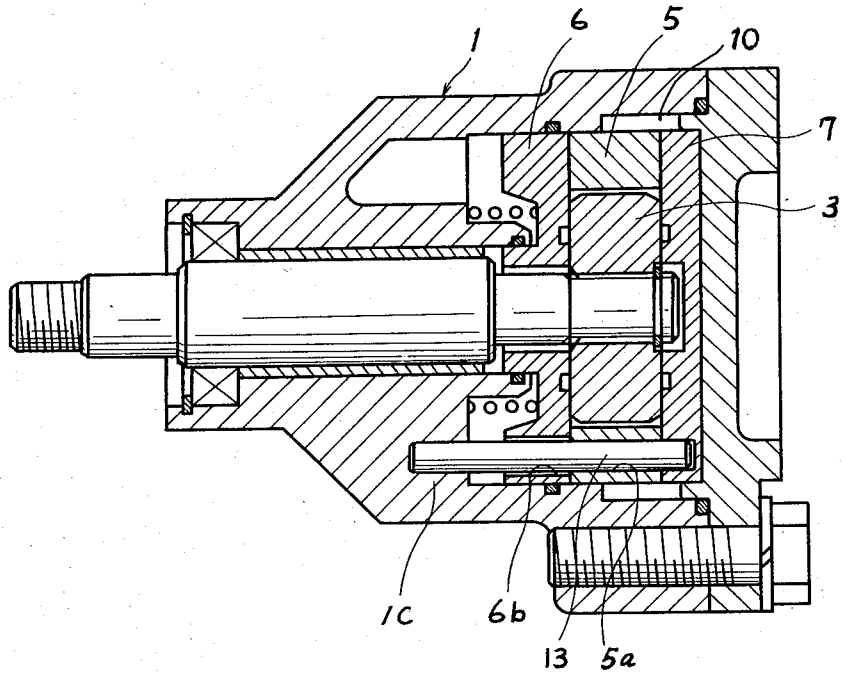
FIG. 1 PRIOR ART
FIG. 1 is a sectional view of a conventional vane pump.
Figure 2:
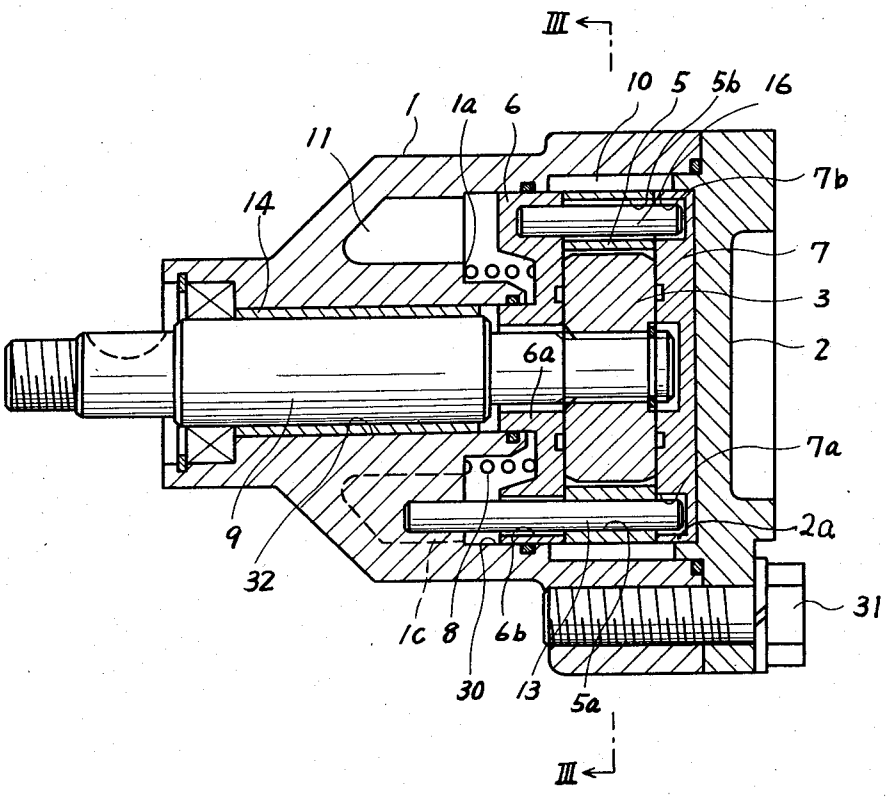
FIG. 2 is a sectional view of a vane pump according to the present invention.

Referring now to the drawings, wherein like reference numerals or characters refer to identical or corresponding parts throughout the several views, and more particularly to FIG. 2, there is shown a pump housing 1 which is formed with a hollow chamber or an inner bore 30. A end cover 2 is fittedly secured to the one side of the pump housing 1 by a plurality of bolts 31 to cover an open end of the hollow chamber 30. Within the hollow chamber 30, there are received a cam ring 5, a side plate 6 facing one side surface of the cam ring 5 and a side plate 7 whose one axial end faces the other side surface of the cam ring 5. The other axial end of the side plate 7 faces the inner end of the end cover 2. The outer surfaces of the side plates 6 and 7 are fitted in the inner bore 30 of the pump housing 1 and an inner end bore 2*a* of the end cover 2, respectively. The side plate 6 is formed at its central portion with a boss 6*a* which is fitted into a bearing bore 32 of the pump housing 1. A compressed spring 8 is interposed between the inner shoulder portion 1*a* of the pump housing 1 and the side plate 6 to maintain the cam ring 5, side plates 6 and 7 and end cover 2 into engagement with one another.

Figure 3:
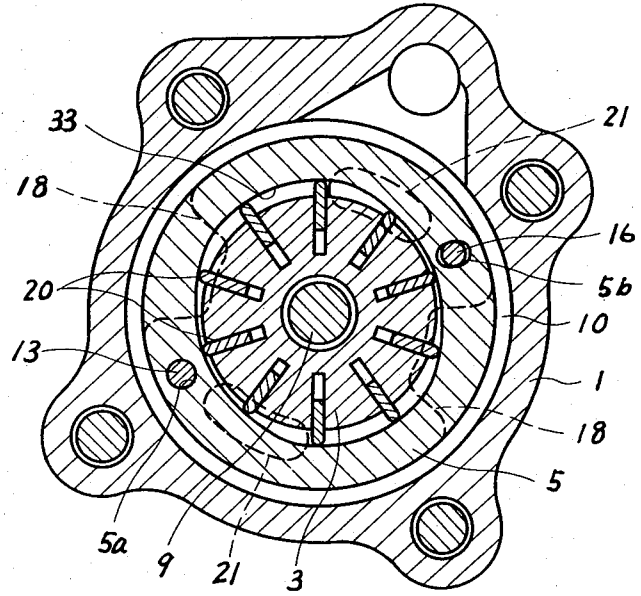
FIG. 3 is a sectional view taken along the line III—III in FIG. 2.

The cam ring 5 is formed with an internal cam surface or bore 33, as illustrated in FIG. 3, within which a pump rotor 3 is received. The pump rotor 3 is formed on its circumferential surface with a plurality of radial slots within which are slidably received respective vanes 20 in sliding contact with the cam surface 33 of the cam ring 5. The pump rotor 3 is in spline connection with one end of a drive shaft 9 which is rotatably supported in a bearing sleeve 14 fitted into the bearing bore 32 of the pump housing 1.

A plurality of pump chambers separated by the vanes 20 are formed between the cam surface 33 of the cam ring 5 and the outer periphery of the pump rotor 3. Each pump chamber is changed in volume by rotation of the pump rotor 3. The side plates 6 and 7 are respectively formed with inlet ports 18 opening to the pump chambers performing an expansion stroke and further with outlet ports 21 opening to the pump chambers performing a compression stroke. The inlet ports 18 communicate with an annular groove 10 formed in the hollow chamber 30 in such a manner as to surround the cam ring 5. The annular groove 10, in turn, communicates with a reservoir, not shown. The outlet ports 21 communicate with a pressure chamber 11 where the above-mentioned compressed spring 8 is disposed. The pressure chamber 11 communicates with a fluid actuated device, such as a power steering device, not shown, through a well known flow control valve, not shown.

In order to position the cam ring 5 and the side plates 6 and 7 in place, a first positioning pin 13 is fitted at one end thereof into a boss portion 1c formed in the pressure chamber 11. The first positioning pin 13 passes through an elongated hole 6b formed in the side plate 6 and passes through a hole 5a formed in the cam ring 5 in fitted relationship therewith. The other end of the first positioning pin 13 is received in an elongated blind hole 7a formed in the side plate 7. The elongated holes 6b and 7a are elongated in a radial direction and the width thereof along the radial direction is in fittable relationship with the first positioning pin 13. The arrangement of the first positioning pin 13 in the above-described manner prevents rotation of the side plates 6 and 7, since the side plates 6 and 7 are fitted in the inner bore 30 of the pump housing 1 and the inner end bore 2a of the end cover 2, respectively.

In order to prevent rotation of the cam ring 5, a second positioning pin 16 is located in a diametrically opposite relationship with the first positioning pin 13, as shown in FIG. 3. The second positioning pin 16 is fitted at one end thereof into a bore in the side plate 6 and passes through an elongated hole 5b formed in the cam ring 5. The bore in the side plate 6 for the second positioning pin 16 does not extend entirely through the side plate 6, and so the positioning pin 16 is prevented from extending into the pressure chamber 11. The other end of the second positioning pin 16 is received in an elongated blind hole 7b formed in the side plate 7. As shown in FIG. 3, the elongated holes 5b and 7b are elongated in a radial direction and the width thereof along the radial direction is in fittable relationship with the second positioning pin 16.

With the above-described arrangement, a grinding operation is not required for the outer periphery of the cam ring 5, resulting in easy assembly of the cam ring 5. Furthermore, the width of the annular groove 10 is made larger, resulting in increase of the suction efficiency.

In operation, when the drive shaft 9 is driven by the automotive engine, the pump rotor 3 is rotated, whereby working fluid is sucked into the pump chambers through the inlet ports 18 from the annular groove 10, and as a result, pressurized fluid is discharged from the pump chambers through the outlet ports 21 into the pressure chamber 11 and then to the power steering device.

What is claimed as new and desired to be secured by Letters Patent of the United States is:

1. A vane pump for a power steering device comprising:

a pump housing having an inner bore;

an end cover secured to said pump housing for covering an open end of said inner bore of said pump housing and having an inner end bore at an inner end thereof;

a cam ring received in said inner bore of said pump housing and having an internal cam bore;

a first side plate fitted in said inner bore of said pump housing for defining a pressure chamber between one side surface thereof and an inner end wall of said pump housing and disposed in contact relationship at the other side surface thereof with one side surface of said cam ring;

a second side plate fitted in said inner end bore of said end cover and disposed in contact relationship with the other side surface of said cam ring;

a drive shaft rotatably carried by said pump housing and extending into said internal cam bore;

a pump rotor carried on said drive shaft for integral rotation therewith and received in said internal cam bore;

a plurality of vanes radially slidably carried on the periphery of said pump rotor for contacting said internal cam bore to define a plurality of pump chambers therewith;

a first positioning pin fitted at one end thereof into said inner end wall of said pump housing and passing through a first elongated hole formed in said first side plate and a hole formed in said cam ring in fitted relationship therewith and received at the other end thereof in a second elongated hole formed in said second side plate for positioning said first and second side said plates in a circumferential direction thereof, said first and second elongated holes being elongated in a radial direction and the width thereof along the radial direction being in fittable relationship with said first positioning pin; and a second positioning pin fitted at one end thereof into one of said first and second side plates and passing through a third elongated hole formed in said cam ring and received at the other end thereof in a fourth elongated hole formed in the other of said first and second side plates for positioning said cam ring against movement within a plane transverse to the axis of said drive shaft in cooperation with said first positioning pin, said third and fourth elongated holes being elongated in a radial direction and the width thereof along the radial direction being in fittable relationship with said second positioning pin, said second positioning pin being prevented from extending into said pressure chamber.

2. A vane pump as set forth in claim 1, wherein each of said second and fourth elongated holes is a blind hole.

* * * * *